US011521784B2

(12) United States Patent
Kim et al.

(10) Patent No.: US 11,521,784 B2
(45) Date of Patent: Dec. 6, 2022

(54) COIL COMPONENT

(71) Applicant: SAMSUNG ELECTRO-MECHANICS CO., LTD., Suwon-si (KR)

(72) Inventors: Jae Hun Kim, Suwon-si (KR); Jong Min Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 600 days.

(21) Appl. No.: 16/539,678

(22) Filed: Aug. 13, 2019

(65) Prior Publication Data

US 2020/0105456 A1 Apr. 2, 2020

(30) Foreign Application Priority Data

Oct. 2, 2018 (KR) ..... 10-2018-0117695

(51) Int. Cl.

| | |
|---|---|
| ***H01F 5/00*** | (2006.01) |
| ***H01F 27/28*** | (2006.01) |
| ***H01F 27/32*** | (2006.01) |
| ***H01F 27/29*** | (2006.01) |

(52) U.S. Cl.

CPC ..... *H01F 27/2804* (2013.01); *H01F 27/29* (2013.01); *H01F 27/323* (2013.01); *H01F 2027/2809* (2013.01)

(58) Field of Classification Search

CPC ..... H01F 27/2804
USPC ..... 336/200
See application file for complete search history.

(56) References Cited

U.S. PATENT DOCUMENTS

| | | | | |
|---|---|---|---|---|
| 10,153,082 | B2 * | 12/2018 | Otani | H01G 4/008 |
| 10,715,041 | B2 | 7/2020 | Hamada et al. | |
| 2007/0040163 | A1 * | 2/2007 | Okuzawa | H01F 27/292 257/31 |

(Continued)

FOREIGN PATENT DOCUMENTS

| | | | |
|---|---|---|---|
| CN | 105702428 | A | 6/2016 |
| CN | 107068351 | A | 8/2017 |

(Continued)

OTHER PUBLICATIONS

Office Action issued in corresponding Korean Patent Application No. 10-2018-0117695, dated Dec. 2, 2019, with English translation.

(Continued)

*Primary Examiner* — Ronald Hinson
(74) *Attorney, Agent, or Firm* — Morgan, Lewis & Bockius LLP

(57) ABSTRACT

A coil component includes a body having one surface and another surface opposing each other in one direction, an internal insulating layer embedded in the body, and a coil portion disposed on the internal insulating layer and forming at least one turn. First and second external electrodes are disposed on the one surface of the body to be spaced apart from each other, and first and second connection electrodes respectively penetrate through the body to connect the coil portion and the first and second external electrodes to each other. A support electrode extends from the coil portion to be exposed to the other surface of the body to support the coil portion and the internal insulating layer.

17 Claims, 9 Drawing Sheets

(56) References Cited

U.S. PATENT DOCUMENTS

| | | | | |
|---|---|---|---|---|
| 2014/0009254 | A1 | 1/2014 | Ohkubo et al. | |
| 2014/0176286 | A1 | 6/2014 | Okada et al. | |
| 2015/0048915 | A1 | 2/2015 | Yoon et al. | |
| 2016/0172103 | A1 | 6/2016 | Jeong et al. | |
| 2017/0098997 | A1* | 4/2017 | Hamada | H01F 1/0306 |
| 2018/0075965 | A1* | 3/2018 | Yoshioka | H01F 27/2823 |
| 2019/0074125 | A1* | 3/2019 | Yoshioka | H01F 41/063 |

FOREIGN PATENT DOCUMENTS

| | | | |
|---|---|---|---|
| JP | 2013-031842 | A1 | 3/2015 |
| KR | 10-2014-0005088 | A | 1/2014 |
| KR | 10-2014-0061812 | A | 5/2014 |
| KR | 10-2015-0019730 | A | 2/2015 |
| WO | 2016/047654 | A1 | 3/2016 |

OTHER PUBLICATIONS

Chinese Office Action dated Aug. 8, 2022, issued in corresponding Chinese Patent Application No. 201910884905.2.

* cited by examiner

COIL COMPONENT

CROSS-REFERENCE TO RELATED APPLICATION(S)

This application claims benefit of priority to Korean Patent Application No. 10-2018-0117695 filed on Oct. 2, 2018 in the Korean Intellectual Property Office, the disclosure of which is incorporated herein by reference in its entirety.

BACKGROUND

1. Field

The present disclosure relates to a coil component.

2. Description of Related Art

An inductor, a coil component, is a representative passive electronic component commonly used in electronic devices together with resistors and capacitors.

A thin-film type inductor is manufactured by forming a coil on a support substrate by plating to form a coil substrate, forming a body by laminating a magnetic composite sheet, obtained by mixing magnetic powder particles with a resin, on the coil substrate to form a body, and forming external electrodes on an external surface of the body.

In accordance with the implementation of high performance electronic devices and the miniaturization thereof, electronic components used in the electronic devices have increased in number and decreased in size. For this reason, a thin-film type coil component and a coil substrate have been thinned.

However, as a coil substrate is thinned, it becomes increasingly difficult to precisely control the coil substrate due to warpage of the coil substrate or the like. As an example, the coil substrate may be located out of position by pressure and heat in a laminating process of a magnetic composite sheet.

SUMMARY

An aspect of the present disclosure is to provide a coil component which may significantly reduce a position error of a coil portion in a body.

An aspect of the present disclosure is to provide a small, light, thin, short coil component.

According to an aspect of the present disclosure, a coil component includes a body having one surface and another surface opposing each other in one direction, an internal insulating layer embedded in the body, and a coil portion disposed on the internal insulating layer and forming at least one turn. First and second external electrodes are disposed on the one surface of the body to be spaced apart from each other, and first and second connection electrodes respectively penetrate through the body to connect the coil portion and the first and second external electrodes to each other. A support electrode extends from the coil portion to be exposed to the other surface of the body to support the coil portion and the internal insulating layer.

According to another aspect of the present disclosure, a coil component includes a body having opposing first and second surfaces, and having a plurality of side surfaces extending between the first and second surfaces. An internal insulating layer is disposed in the body, and a coil including a plurality of coil turns is disposed on a surface of the insulating layer facing the first surface. A first connection electrode is embedded in the body, is spaced apart from the side surfaces of the body, and extends between the coil and the first surface of the body. A support electrode is embedded in the body, is spaced apart from the side surfaces of the body, and extends between the coil and the second surface of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
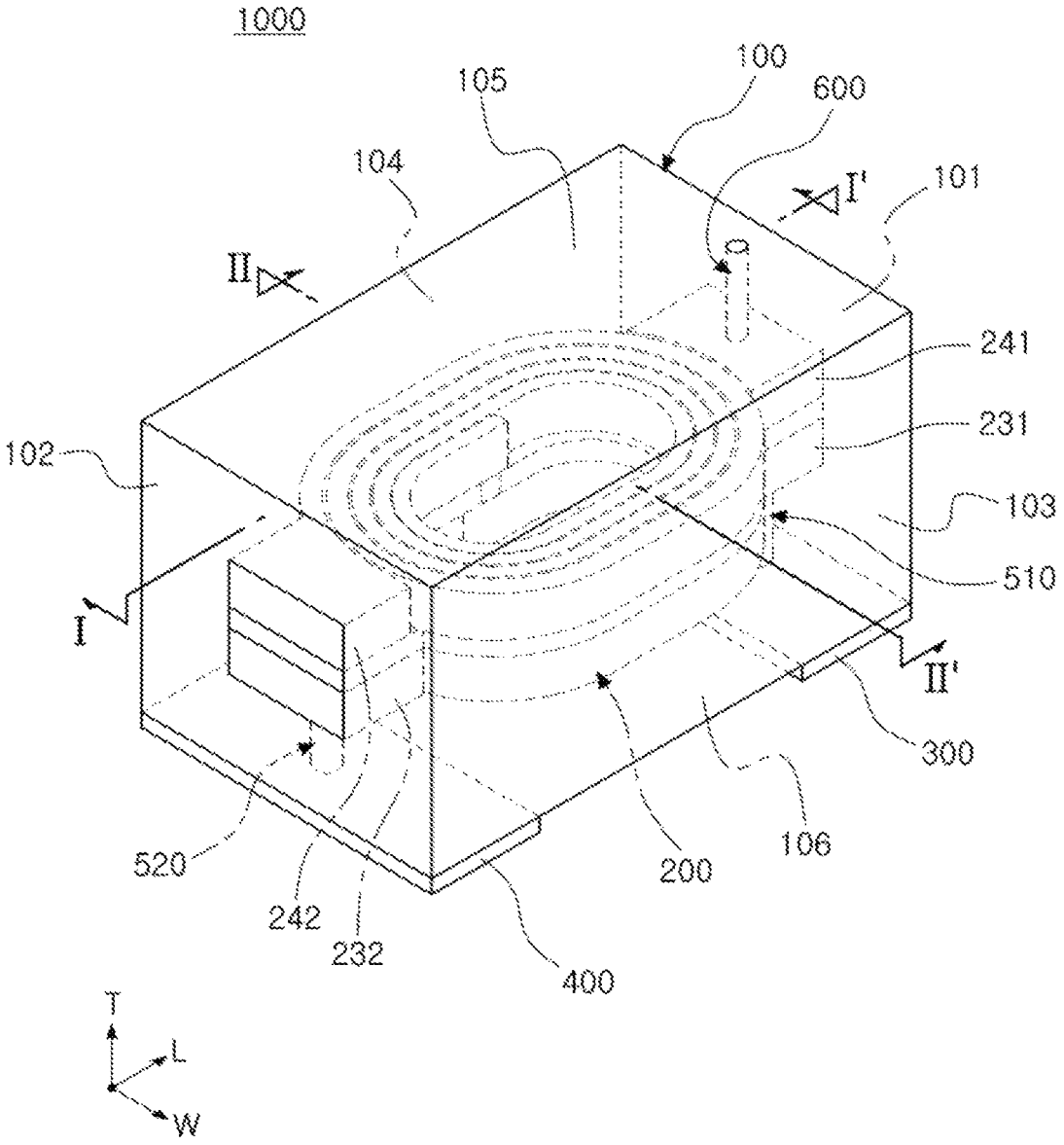
FIG. 1 is a schematic diagram of a coil component according to a first embodiment in the present disclosure.

Hereinafter, embodiments of the present disclosure will be described as follows with reference to the attached drawings.

The terms used in the example embodiments are used to simply describe an example embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts, or combination thereof, and do not exclude the possibilities of combination or addition of one or more further features, numbers, steps, operations, elements, parts, or combination thereof. Also, the term "disposed on," "positioned on," and the like, may indicate that an element is positioned below an object, and does not necessarily mean that the element is positioned on the object with reference to a gravity direction.

The term "coupled to," "combined to," and the like, may not only indicate that elements are directly and physically in contact with each other, but also include configurations in which another element is interposed between the elements such that the elements are also in contact with the other component.

Sizes and thicknesses of elements illustrated in the drawings are indicated as examples for ease of description, and example embodiments in the present disclosure are not limited thereto.

In the drawings, an L direction is a first direction or a length direction, a W direction is a second direction or a width direction, and a T direction is a third direction or a thickness direction.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

First Embodiment

Figure 2:
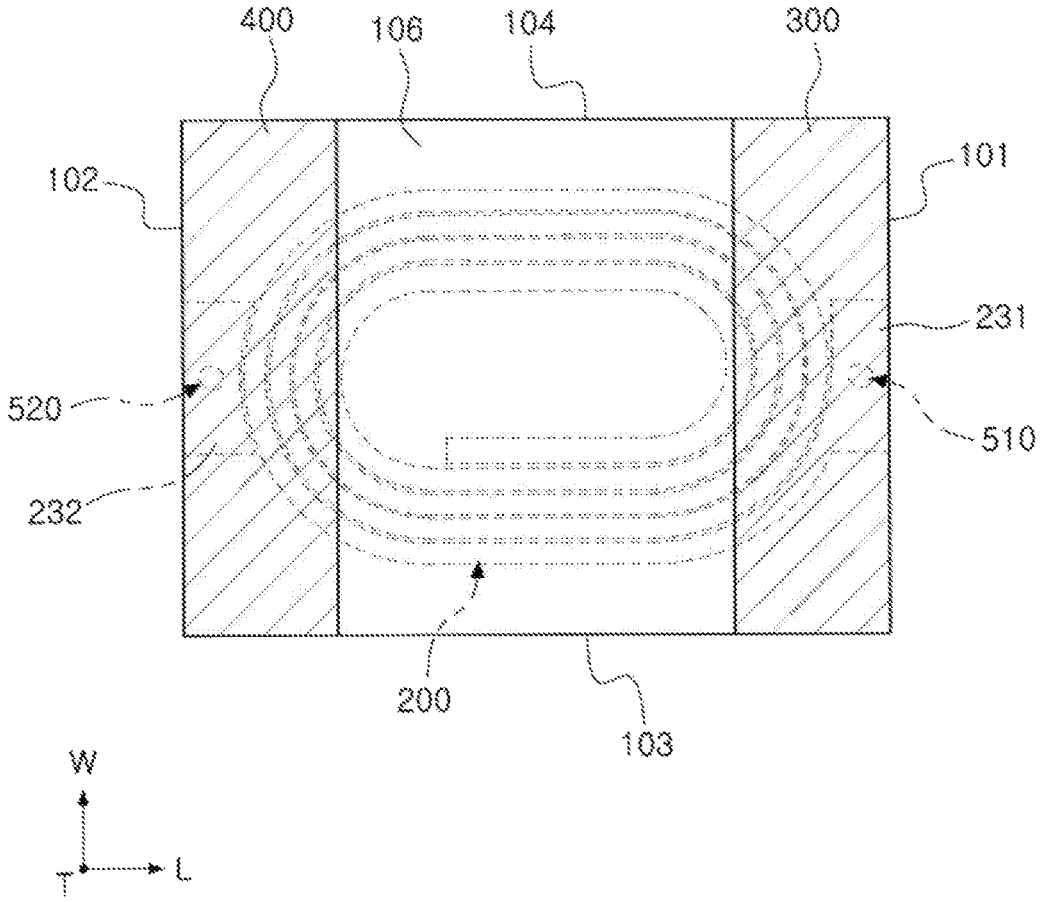
FIG. 2 is a diagram showing the coil component when viewed from a lower side of FIG. 1.
Figure 3:
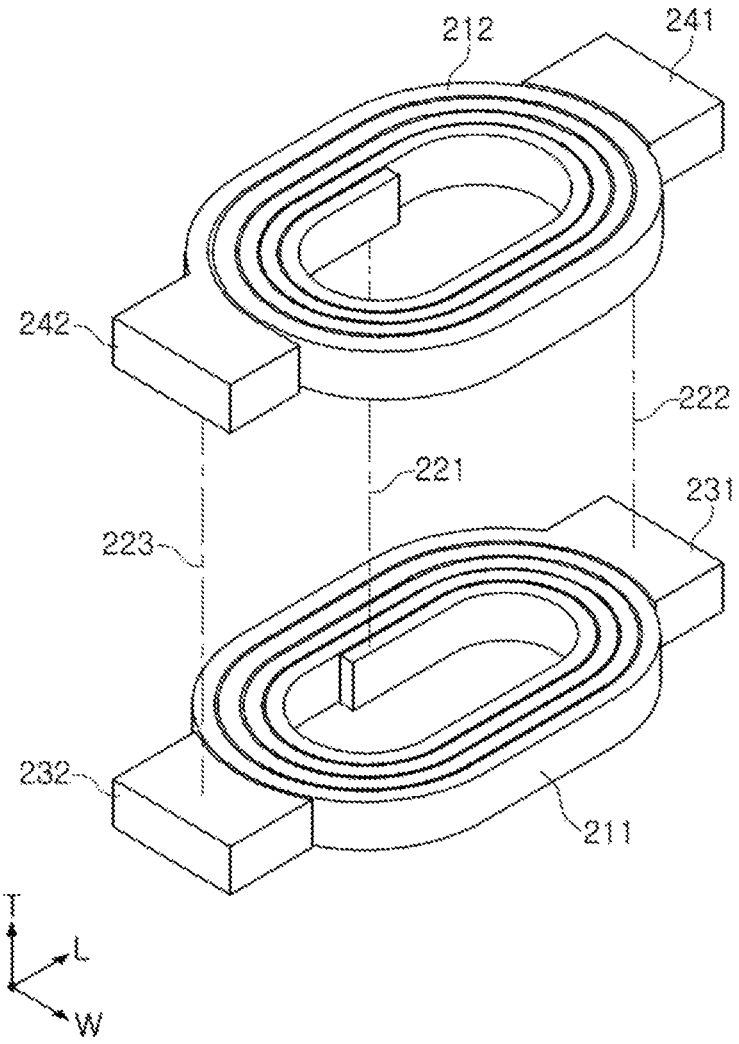
FIG. 3 is an exploded view of a coil portion.
Figure 4:
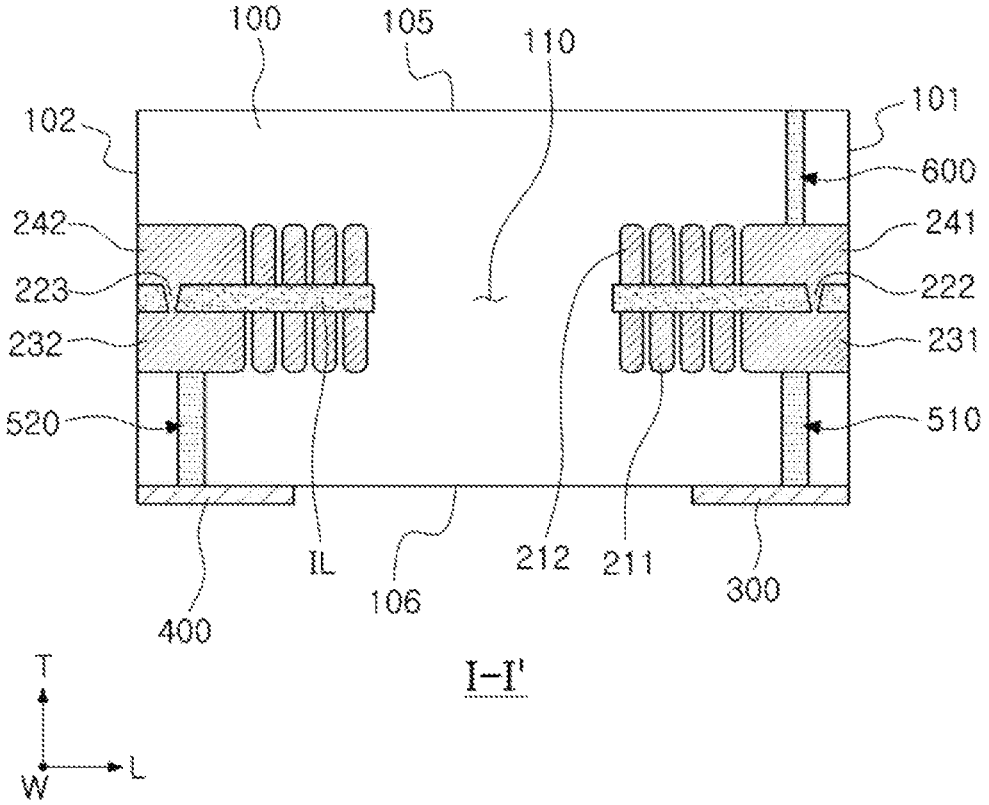
FIG. 4 is a cross-sectional view taken along line I-I' of FIG. 1.
Figure 5:
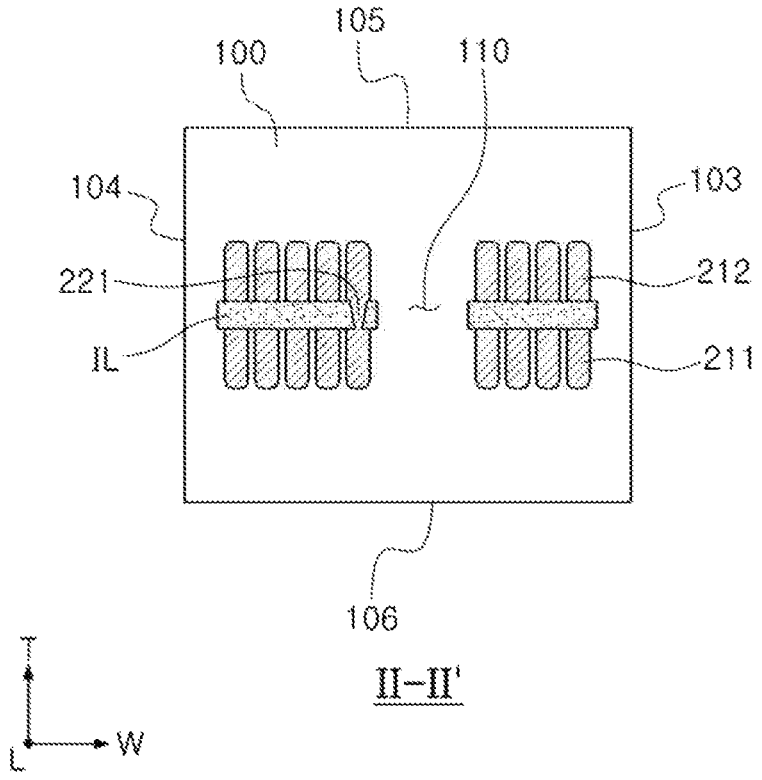
FIG. 5 is a cross-sectional view taken along line II-II' of FIG. 1.

FIG. 1 is a schematic diagram of a coil component according to a first embodiment in the present disclosure. FIG. 2 is a diagram showing the coil component when viewed from a lower side of FIG. 1. FIG. 3 is an exploded view of a coil portion. FIG. 4 is a cross-sectional view taken along line I-I' of FIG. 1, and FIG. 5 is a cross-sectional view taken along line II-II' of FIG. 1.

Referring to FIGS. 1 to 5, a coil component 1000 according to the first embodiment may include a body 100, an internal insulating layer IL, a coil portion 200, external electrodes 300 and 400, connection electrodes 510 and 520, and a support electrode 600.

The body 100 forms an exterior of the coil component 1000, and the coil portion 400 is embedded in the body 100.

The body 100 may have a substantially hexahedral shape.

The body 100 may have, on the basis of FIG. 1, a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. Each of the first to fourth surfaces 101, 102, 103, and 104 of the body 100 connects the fifth surface 105 and the sixth surface 106 of the body 100. Hereinafter, "both end surfaces of the body 100" will refer to the first surface 101 and the second surface 102, "both side surfaces of the body 100" will refer to the third surface 103 and the fourth surface 104 of the body 100, and "one surface and the other surface of the body 100" will refer to the sixth surface 106 and the fifth surface 105, respectively.

As an example, the body 100 may be formed such that the coil component 1000, on which the external electrodes 300 and 400 to be described later are disposed, may have a length of 2.0 mm, a width of 1.2 mm, and a thickness of 0.65 mm, but the dimensions of the body 100 are not limited thereto.

The body 100 may include a magnetic material and a resin material. Specifically, the body 100 may be formed by laminating one or more magnetic composite sheets including a magnetic material dispersed in a resin. Alternatively, the body 100 may have a structure different from the structure in which a magnetic material is dispersed in a resin. For example, the body 100 may be formed of a magnetic material such as a ferrite.

The magnetic material may be a ferrite or magnetic metal powder particles.

The ferrite power particles may include at least one of, for example, spinel type ferrites such as ferrites that are Mg—Zn-based, Mn—Zn-based, Mn—Mg-based, Cu—Zn-based, Mg—Mn—Sr-based, Ni—Zn-based, hexagonal ferrites such as ferrites that are Ba—Zn-based, Ba—Mg-based, Ba—Ni-based, Ba—Co-based, Ba—Ni—Co-based, or the like, garnet ferrites such as Y-based ferrite, and Li-based ferrite.

Magnetic metal powder particles may include at least one selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particles may include at least one of pore ion powder particles, Fe—Si-based alloy powder particles, Fe—Si—Al-based alloy powder particles, Fe—Ni-based alloy powder particles, Fe—Ni—Mo-based alloy powder particles, Fe—Ni—Mo—Cu-based alloy powder particles, Fe—Co-based alloy powder particles, Fe—Ni—Co-based alloy powder particles, Fe—Cr-based alloy powder particles, Fe—Cr—Si-based alloy powder particles, Fe—Si—Cu—Nb-based alloy powder particles, Fe—Ni—Cr-based alloy powder particles, and Fe—Cr—Al-based alloy powder particles.

The metallic magnetic powder particles may be amorphous or crystalline. For example, the magnetic metal powder particles may be Fe—Si—B—Cr-based amorphous alloy powder particles, but the disclosure is not limited thereto.

Each of the ferrite and the magnetic metal powder particles may have an average diameter of about 0.1 μm to about 30 μm, but an example of the average diameter is not limited thereto.

The body 100 may include two or more different types of magnetic materials dispersed in a resin. The expression "different types of magnetic materials" refers to the magnetic materials dispersed in the resin being distinguished from each other by any one of an average diameter, a composition, crystallinity, and a shape.

The resin may include epoxy, polyimide, liquid crystal polymer, and the like, alone or in combination, but a material of the resin is not limited thereto.

The body 100 includes a core 110 penetrating through the coil portion 200 to be described later. The core 110 may be formed by filling a through-hole of the coil portion 200 with the magnetic composite sheet, but formation of the core 110 is not limited thereto.

The insulating layer IL is embedded in the body 100. The insulating layer IL serves to support the coil portion 200 to be described later.

The insulating layer IL may be formed of an insulating material including at least one of thermosetting insulating resins such as an epoxy resin, thermoplastic insulating resins such as polyimide, and photosensitive insulating resins, or an insulating material in which a reinforcing material such as glass fiber or an inorganic filler is impregnated in this insulating resin. As an example, the internal insulating layer IL may be formed of an insulating material such as prepreg, an Ajinomoto build-up film (ABF), FR-4, a Bismaleimide Triazine (BT) resin, a photoimageable dielectric (PID), or the like, but is not limited thereto.

The inorganic filler may be at least one selected from the group consisting of silica ($SiO_2$), alumina ($Al_2O_3$), silicon carbide (SiC), barium sulfate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

When the internal insulating layer IL is formed of an insulating material containing a reinforcing material, the internal insulating layer IL may provide more excellent rigidity. When the internal insulating layer IL is formed of an insulating material including no glass fiber, the internal insulating layer IL is advantageous for thinning of the entire coil portion 200. When the internal insulating layer IL is formed of an insulating material including a photosensitive insulating resin, the number of manufacturing process steps may be decreased, which is advantageous for a decrease in manufacturing costs, and a fine via may be formed.

The coil portion 200 may be embedded in the body 100 to exhibit characteristics of a coil component. For example, when the coil component 1000 according to this embodiment is used as a power inductor, the coil portion 200 may serve to stabilize power of an electronic device by storing an electric field as a magnetic field and maintaining an output voltage.

The coil portion 200 includes coil patterns 211 and 212, lead-out patterns 231 and 232, auxiliary lead-out patterns 241 and 242, and vias 221, 222, and 223.

Specifically, on the basis of FIGS. 4 and 5, a first coil pattern 211, a first lead-out pattern 231, and a second lead-out pattern 232 are disposed on a bottom surface of the internal insulating layer IL facing the sixth surface 106 of the body 100, and a second coil pattern 212, a first auxiliary lead-out pattern 241, and a second auxiliary lead-out pattern 242 are disposed on a top surface of the internal insulating layer IL opposing the bottom surface of the internal insulating layer IL.

Referring to FIGS. 3 to 5, on the bottom surface of the internal insulating layer IL, the first coil pattern 211 is in contact with and connected to the first lead-out pattern 231 and both of the first coil pattern 211 and the first lead-out pattern 231 are spaced apart from the second lead-out pattern 232. On the top surface of the internal insulating layer IL, the second coil pattern 212 is in contact with and connected to the second auxiliary lead-out pattern 242 and both of the second coil pattern 212 and the second auxiliary lead-out pattern 242 are spaced apart from the first auxiliary lead-out pattern 241. The first via 221 penetrates through the internal insulating layer IL to be in contact with the first coil pattern 211 and the second coil pattern 212, the second via 222 penetrates through the internal insulating layer IL to be in contact with the first lead-out pattern 231 and the first auxiliary lead-out pattern 241, and the third via 223 penetrates through the internal insulating layer IL to be in contact with the second lead-out pattern 232 and the second auxiliary lead-out pattern 242. Thus, the coil portion 200 including the first and second coil patterns 211 and 212 may generally serve as a single coil.

Each of the first coil pattern 211 and the second coil pattern 212 may have a planar spiral shape forming at least one turn centered on the core 110 as an axis. For example, the first coil pattern 211 and may form at least one turn on a bottom surface of the internal insulating layer IL centered on the core 110 as an axis.

The lead-out patterns 231 and 232 and the auxiliary lead-out patterns 241 and 242 may be exposed to the opposing end surfaces 101 and 102 of the body 100, respectively. For example, both of the first lead-out pattern 231 and the first auxiliary lead-out pattern 241 are exposed to the first surface 101 of the body 100, and both of the second lead-out pattern 232 and the second auxiliary lead-out pattern 242 are exposed to the second surface 102 of the body 100.

At least one of the coil patterns 211 and 212, the vias 221, 222, and 223, the lead-out patterns 231 and 232, and the auxiliary lead-out patterns 241 and 242 may include at least one conductive layer.

As an example, when the second coil pattern 212, the auxiliary lead-out pattern 241 and 242, and the vias 221, 222, and 223 are formed on the other surface of the internal insulating layer IL by plating, each of the second coil pattern 212, the auxiliary lead-out pattern 241 and 242, and the vias 221, 222, and 223 may include a seed layer such as an electroless plating layer and an electroplating layer. The electroplating layer may have a single-layer structure or a multilayer structure. The electroplating layer of the multilayer structure may be formed in a conformal film structure in which one electroplating layer is covered with another electroplating layer, and may be formed so that another plating layer is laminated only on one surface of one electroplating layer. The seed layer of the second coil pattern 212, the seed layers of the auxiliary lead-out patterns 241 and 242, and the seed layers of the vias 221, 222, and 223 may be formed integrally with each other, such that boundaries therebetween may not be formed, but are not limited thereto. The electroplating layer of the second coil pattern 212, the electroplating layers of the auxiliary lead-out patterns 241 and 242, and the electroplating layers of the vias 221, 222, and 223 may be formed integrally with each other, such that a boundary therebetween is not formed, but are not limited thereto.

On the basis of FIGS. 4 and 5, the coil patterns 211 and 212, the lead-out pattern 231 and 232, and the auxiliary lead-out patterns 241 and 242 may be formed to protrude from the bottom and top surfaces of the internal insulating layer IL, respectively. As another example, the first coil pattern 211 and the lead-out patterns 231 and 232 may be formed to protrude on the bottom surface of the internal insulating layer IL, and the second coil pattern 212 and the second auxiliary lead-out patterns 241 and 242 may be embedded in the top surface of the internal insulating layer IL, such that a top surface of each of the second coil pattern 212 and the auxiliary lead-out patterns 241 and 242 may be exposed through the top surface of the internal insulating layer IL. In this case, a concave portion may be formed in the top surface of the second coil pattern 212 and/or the top surfaces of the auxiliary lead-out patterns 241 and 242, such that the top surface(s) of the second coil pattern 212 and/or the auxiliary lead-out patterns 241 and 242, and the top surface of the internal insulating layer IL may not be disposed on the same plane.

Each of the coil patterns 211 and 212, the lead-out patterns 231 and 232, the auxiliary lead-out patterns 241 and 242, and the vias 221, 222, and 223 may be formed of a conductive material such as copper (Cu), aluminum (Al), silver (Ag), tin (Sn), gold (Au), nickel (Ni), lead (Pb), titanium (Ti), or alloys thereof, but a material thereof is not limited thereto.

Referring to FIG. 3, since the first auxiliary lead-out pattern 241 provides no necessary electrical connection between the other elements of the coil portion 200, the first auxiliary lead-out pattern 241 may be omitted. However, in detail, the first auxiliary lead-out pattern 241 may be formed to omit a process in which the fifth surface 105 and the sixth surface 106 of the body 100 should be distinguished from each other prior to the forming of the first and second external electrodes 300 and 400.

The first and second external electrodes 300 and 400 may be disposed on the sixth surface 106 of the body 100 to be spaced apart from each other.

The first and second external electrodes 300 and 400 may be formed to have a single-layer structure or a multilayer structure. As an example, the first external electrode 300 may include a first layer including copper (Cu), a second layer, disposed on the first layer, including nickel (Ni), and a third layer, disposed on the second layer, including tin (Sn).

The connection electrodes 510 and 520 penetrate through the body 100 to connect the first and second external electrode 300 and 400 and the first and second lead-out patterns 231 and 232, respectively, to each other. For example, in this embodiment, the first and second external electrodes 300 and 400 and the first and second lead-out patterns 231 and 232 are connected through the connection electrodes 510 and 520, respectively, disposed in the body 100, rather than through a conductor disposed on or along a surface of the body 100. Specifically, a first connection electrode 510, penetrating through the body 100 and extending from the first lead-out pattern 231 to the sixth surface 106 of the body 100, is in contact with and connected to the first external electrode 300 through an end portion thereof exposed to the sixth surface 106 of the body 100. A second connection electrode 520, penetrating through the body 100 and extending from the second lead-out pattern 232 to the sixth surface 106 of the body 100, is in contact with and connected to the second external electrode 400 through the end portion thereof exposed to the sixth surface 106 of the body 100.

The support electrode 600 may extend from the coil portion 200 to be exposed to the fifth surface 105 of the body 100 to support the coil portion 200 and the internal insulating layer IL. In this embodiment, the support electrode 600 extends from the first auxiliary lead-out pattern 241 of the coil portion 200, disposed on the other surface of the internal insulating layer IL, to extend to the fifth surface 105 of the body 100. An end portion of the support electrode 600 is exposed to the fifth surface 105 of the body 100.

The support electrode 600 may be disposed on (e.g., and/or in contact with) the first auxiliary lead-out pattern 241 or the second auxiliary lead-out pattern 242. For example, the support electrode 600 may be selectively disposed on the first auxiliary lead-out pattern 241 or the second auxiliary lead-out pattern 242. Accordingly, in one alternative embodiment, the support electrode 600 may only be disposed on the second auxiliary lead-out pattern 242 and may not be disposed on the first auxiliary lead-out pattern 241, unlike as illustrated in the drawings. In this alternative case, since the first auxiliary lead-out pattern 241 provides no necessary electrical connection between the other elements of the coil portion 200, the first auxiliary lead-out pattern 241 may be omitted.

The support electrode 600 may have a volume smaller than a volume of each of the first and second connection electrodes 510 and 520. Since the first and second connection electrodes 510 and 520 are respectively in contact with and connected to the external electrodes 300 and 400, each of the first and second connection electrodes 510 and 520 may have a relatively greater volume to improve bonding force with the external electrodes 300 and 400. However, the support electrode 600 supports the internal insulating layer IL and the coil portion 200 but does not electrically connect the coil portion 200 to an external element, as will be described later. Accordingly, the support electrode 600 may have a relatively smaller volume (e.g., a smaller diameter) than the first and second connection electrodes 510 and 520.

The supporting electrode 600 supports the coil portion 200 and the internal insulating layer IL together with the connection electrodes 510 and 520, which will now be described.

Generally, a thin-film coil component is manufactured by forming coil portions on both surfaces of an internal insulating layer by a thin-film process such as a plating process to manufacture a coil substrate, laminating and curing a magnetic composite sheet on both surfaces of the coil substrate to form a body, and forming external electrodes on external surfaces of the body by plating or the like. A coil substrate and a body have been thinned depending on a demand for thinning of a coil component. However, when the coil substrate is thinned, defects are increased due to heat and pressure in a laminating process of a magnetic composite sheet. Specifically, the coil substrate may be deformed by the heat and pressure in the laminating process, and a position of the coil substrate in the body may be different from a designed position.

Each of the connecting electrodes 510 and 520 and the support electrode 600, applied to this embodiment, may support the internal insulating layer IL and the coil portion 200 in a laminating process of the magnetic composite sheet. For example, each of the connection electrodes 510 and 520 and the support electrode 600 may be formed on the coil substrate before lamination of the magnetic composite sheet to suppress deformation and flow of the coil substrate in the laminating process of the magnetic composite sheet.

Each of the connection electrodes 510 and 520 and the support electrode 600 may extend from the coil portion 200. As an example, the connection electrodes 510 and 520 may be formed by forming a plating resist having an opening on the first and second lead-out patterns 231 and 232 and growing the plating resist from the first and second lead-out patterns 231 and 231 exposed by the opening of the plating resist. This method is different from a method according to a related art in which a body is formed, a via hole is processed on a sixth surface side of the body, a seed layer is formed in the via hole, and the via hole is filled with an electroplating layer. For example, since the connection electrodes 510 and 520 and the support electrode 600 of this embodiment are formed in a bottom-up process, there is no seed layer such as an electroless plating layer at a boundary with the coil portion 200 (e.g., interfaces between the coil portion 200 and each of the connection electrodes 510 and 520 and the support electrode 600 are free of any seed layers). Since the via hole is not formed in the body 100, loss of the coil portion 200, caused by a physical impact of a via hole forming device applied to the coil portion or extension of the via hole to the coil portion, may be prevented.

Each of the connection electrodes 510 and 520 and the support electrode 600 may be formed of a conductive material such as copper (Cu), aluminum (Al), silver (Ag), tin (Sn), gold (Au), nickel (Ni) (Pb), chromium (Cr), titanium (Ti), or alloys thereof. However, a material thereof is not limited thereto.

In FIG. 1, each of the connection electrodes 510 and 520 and the support electrode 600 is illustrated as being unitarily formed to have a cylindrical shape. However, this is just an example for ease of description. As an example, the first connection electrode 510 may include a plurality of first connection electrodes, and each may have a square pillar shape. As another example, each of the first and second connection electrodes 510 and 520 may be formed to have a unitary square pillar shape, and the support electrode 600 may include a plurality of support electrodes, each extending to the first auxiliary lead-out pattern 241 and each being formed to have a cylindrical shape.

Although not illustrated in the drawings, the coil component 1000 according to this embodiment may further include an insulating layer formed along the surfaces of the lead-out patterns 231 and 232, the coil patterns 211 and 212, the internal insulating layer IL, and the auxiliary lead-out patterns 241 and 242. The insulating layer may be provided to insulate the lead-out patterns 231 and 232, the coil patterns 211 and 212, and the auxiliary lead-out patterns 241 and 242 from the body 100 and may include an insulating material such as parylene. A material of the insulating material may be any insulating material and is not limited. The insulating layer may be formed by vapor deposition or the like, but a method of forming the insulating layer is not limited thereto and may alternatively be formed by laminating an insulating film on both surfaces of the internal insulating layer IL.

Second Embodiment

Figure 6:
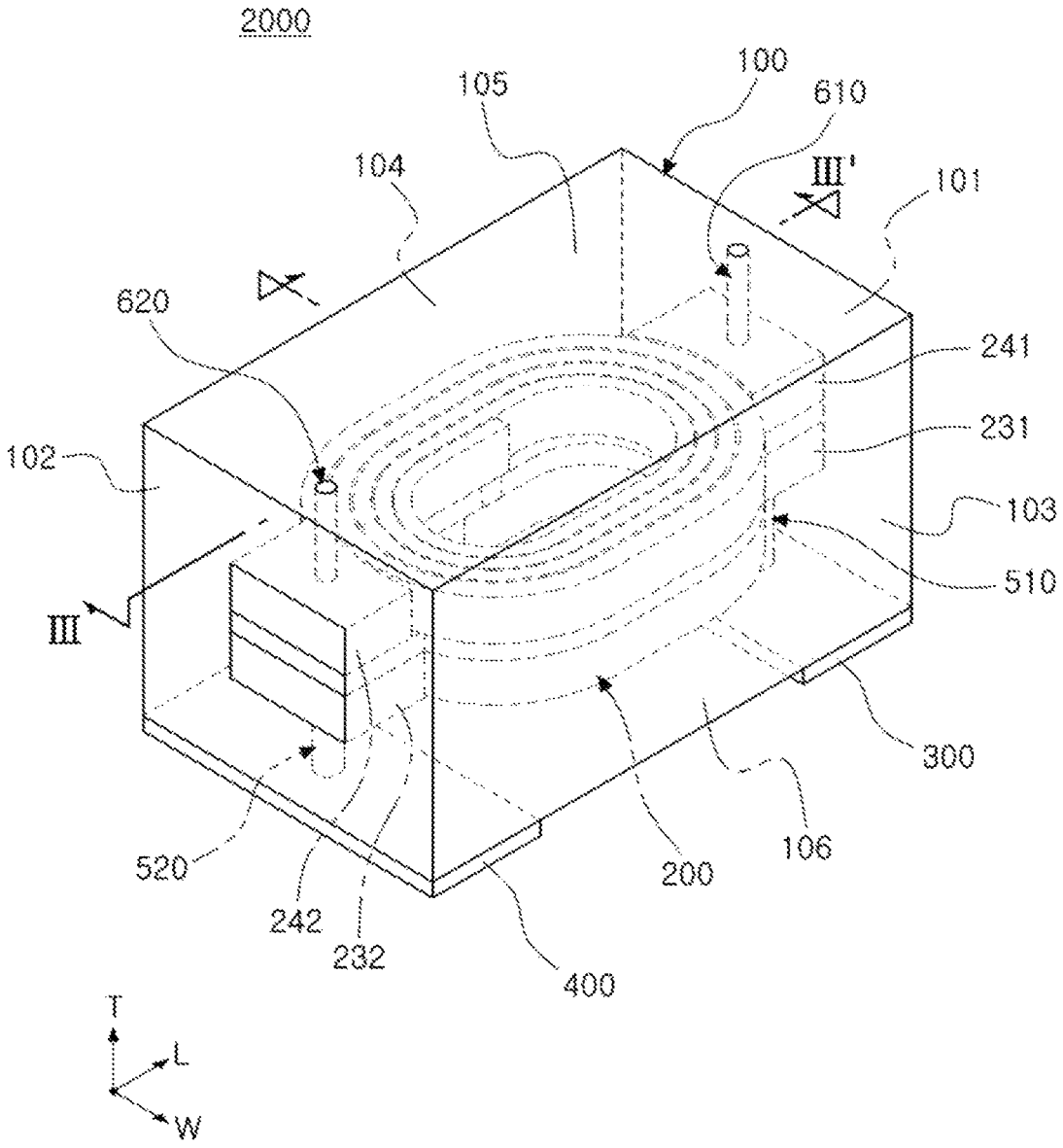
FIG. 6 is a schematic diagram of a coil component according to a second embodiment in the present disclosure.
Figure 7:
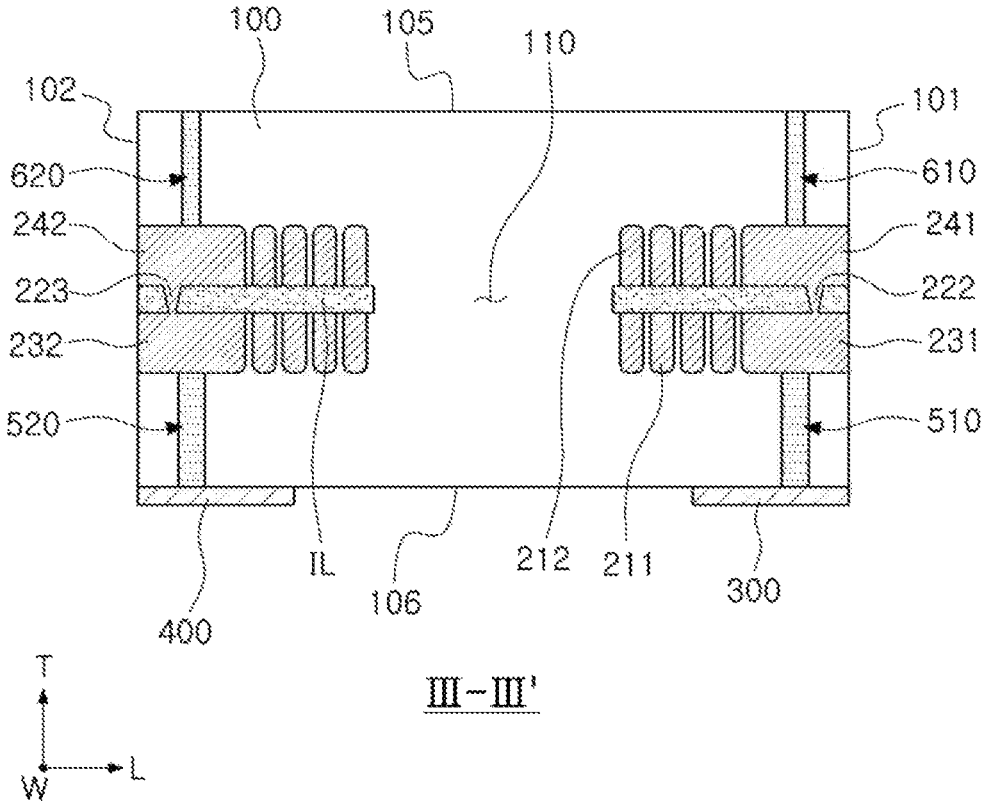
FIG. 7 is a cross-sectional view taken along line III-III' of FIG. 6.

FIG. 6 is a schematic diagram of a coil component according to a second embodiment in the present disclosure, and FIG. 7 is a cross-sectional view taken along line III-III' of FIG. 6.

Referring to FIGS. 1 to 7, a coil component 2000 according to this embodiment has support electrodes 610 and 620 different from the support electrode 600 of the coil component 1000 according to the first embodiment. Therefore, this embodiment will be described with respect to only the support electrodes 610 and 620, which are a difference from the first embodiment. The descriptions of other elements of the first embodiment may be applied, as it is, to the other elements of this second embodiment.

The supporting electrodes 610 and 620, applied to this embodiment, are formed as a pair of support electrodes, and the pair of support electrodes 610 and 620 are respectively formed on the first and second auxiliary lead-out patterns 241 and 242 to be spaced apart from each other. Each of the pair of support electrodes 610 and 620 extends from the respective one of the first and second auxiliary lead-out patterns 241 and 242 to be exposed to the fifth surface 105 of the body 100.

Unlike the first embodiment, in the second embodiment, the support electrodes 610 and 620 are formed on the first and second auxiliary lead-out patterns 241 and 242, respectively. Thus, deformation of a coil substrate, or the like, may be effectively prevented in a laminating process of a magnetic composite sheet laminating process.

Third Embodiment

Figure 8:
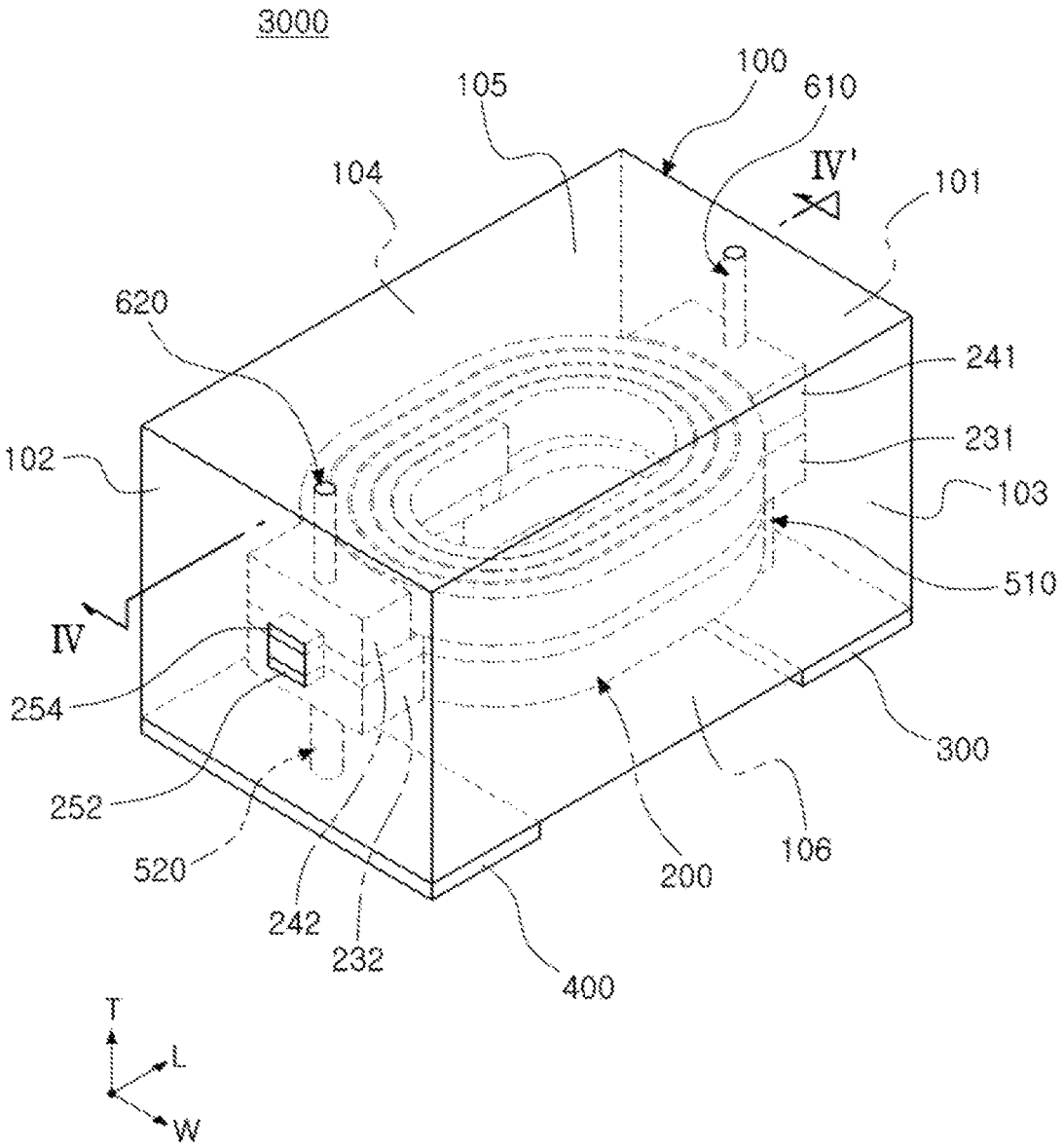
FIG. 8 is a schematic diagram of a coil component according to a third embodiment in the present disclosure.
Figure 9:
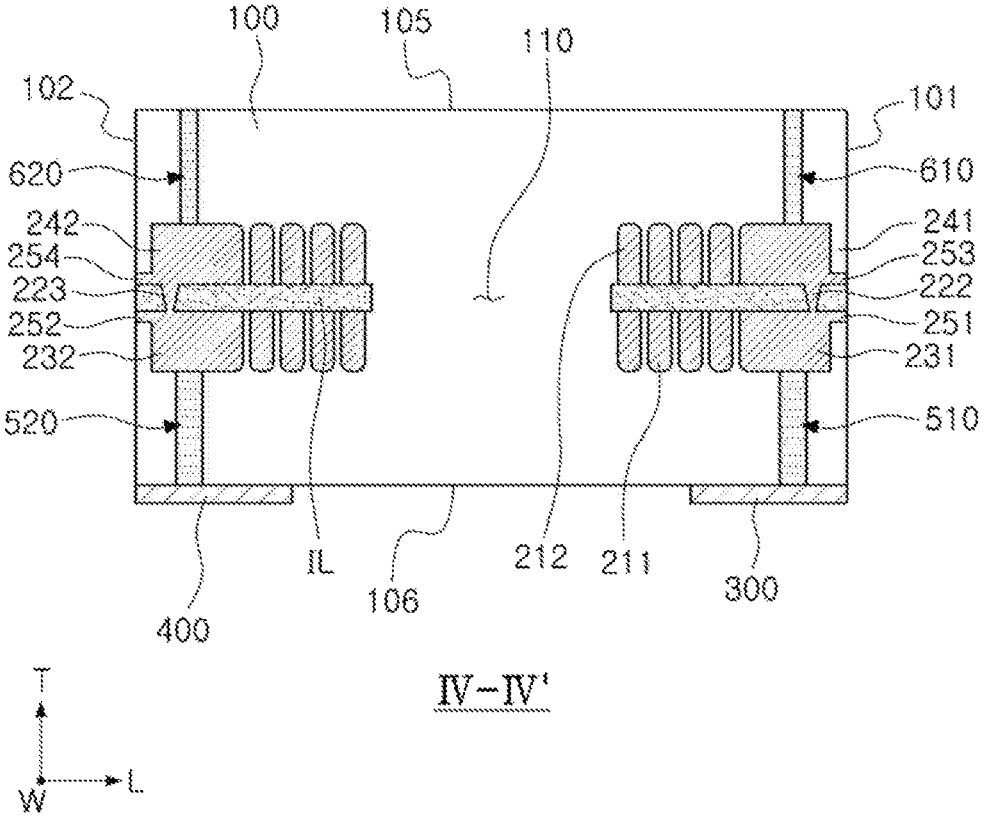
FIG. 9 is a cross-sectional view taken along line IV-IV' of FIG. 6.

FIG. 8 is a schematic diagram of a coil component according to a third embodiment in the present disclosure, and FIG. 9 is a cross-sectional view taken along line IV-IV' of FIG. 6.

Referring to FIGS. 1 to 8, a coil component 3000 according to this embodiment has a coil portion 200 different from that of the coil components 1000 and 2000 according to the first and second embodiments. Therefore, this embodiment will only be described with respect to the coil portion 200, which is a difference from the first and second embodiment. The descriptions of other elements of the first and second embodiments may be applied, as it is, to the other elements of this third embodiment.

The coil portion 200, applied to this embodiment, extends from each of lead-out patterns 231 and 232 and auxiliary lead-out patterns 241 and 232 to further include bonding enhancing portions 251, 252, 253, and 254 exposed to first and second surfaces 101 and 102. Specifically, the coil portion 200 includes a first bonding enhancing portion 251, extending from the first lead-out pattern 231 to be exposed to a first surface 101 of the body 100, a second bonding enhancing portion 252, extending from the second lead-out pattern 232 to be exposed to a second surface 102 of the body 100, a third bonding enhancing portion 253, extending from a first auxiliary lead-out pattern 241 to be exposed to the first surface 101 of the body 100, and a fourth bonding enhancing portion 254, extending from a second auxiliary lead-out pattern 242 to be exposed to the second surface 102 of the body 100.

Unlike the first embodiment, in this embodiment, the lead-out patterns 231 and 232 and the auxiliary lead-out patterns 241 and 242 are not exposed to the first and second surfaces 101 and 102 of the body 100. Instead, the bonding enhancing portions 251, 252, 253, and 254, each extending from one of the lead-out patterns 231 and 232 and the auxiliary lead-out patterns 241 and 242 to one of the end surfaces 101 and 102 of the body 100, are exposed to the first and second surfaces 101 and 102 of the body 100.

On the basis of a cross-section in a width-thickness direction W-T, each of the bonding enhancing portions 251, 252, 253, and 254 may have a width smaller than a width of each of the lead-out patterns 231 and 232 and the auxiliary lead-out pattern 241 and 242 and/or may have a thickness smaller than a thickness of each of the lead-out patterns 231 and 232 and the auxiliary lead-out patterns 241 and 242. For example, the bonding enhancing portions 251, 252, 253, and 254 may reduce a volume of an end side of the coil portion 200 to significantly reduce an area of coil portions 200 exposed to the first and second surfaces 101 and 102 of the body 100.

Thus, the coil component 3000 according to this embodiment may improve bonding force between the coil portion 200 and the body 100. For example, the volume (or area) of a region of the coil portion 200, formed (or exposed) outside of the body 100, is reduced to improve the bonding force between the coil portion 200 and the body 100.

In addition, the coil component 3000 according to this embodiment may prevent degradation in component characteristics by increasing an effective volume of a magnetic material.

Moreover, in the coil component 3000 according to this embodiment, an area of the coil portion 200, exposed to both end surfaces 101 and 102 of the body 100, may be reduced to prevent an electrical short-circuit.

In this embodiment, each of the bonding enhancing portions 251, 252, 253, and 254 may be provided as a plurality of bonding enhancing portions on the lead-out patterns 231 and 232 and the auxiliary lead-out patterns 241 and 242. Specifically, at least one of the first, second, third, and fourth bonding enhancing portions 251, 252, 253, and 254 may be provided with a plurality of bonding enhancing portions. In this case, a contact area between the coil portion 200 and the body 100 may be increased to further enhance the bonding force between the coil portion 200 and the body 100.

As described above, according to the present disclosure, a position error of a coil portion in a body may be significantly reduced.

In addition, according to the present disclosure, a small, light, thin, and short coil component may be implemented.

While example embodiments have been shown and described above, it will be apparent to those skilled in the art that modifications and variations could be made without departing from the scope of the present disclosure as defined by the appended claims.

What is claimed is:

1. A coil component comprising:

a body having one surface and another surface opposing each other in one direction;

an internal insulating layer embedded in the body;

a coil portion, disposed on the internal insulating layer, forming at least one turn;

first and second external electrodes disposed on the one surface of the body to be spaced apart from each other;

first and second connection electrodes respectively penetrating through the body to connect the coil portion and the first and second external electrodes to each other; and a support electrode extending from the coil portion to be exposed to a portion of the another surface of the body, devoid of any external electrode thereon, to support the coil portion and the internal insulating layer.

2. The coil component of claim 1, wherein the support electrode has a volume smaller than a volume of each of the first and second connection electrodes.

3. The coil component of claim 1, wherein at least one of the first and second connection electrodes and the support electrode comprises a plurality of electrodes.

4. The coil component of claim 1, wherein the coil portion comprises:

first and second coil patterns, respectively disposed on one surface and another surface of the internal insulating layer opposing each other;

a first lead-out pattern disposed on the one surface of the internal insulating layer facing the one surface of the body, and in contact with the first coil pattern and the first connection electrode; and a second lead-out pattern disposed on the one surface of the internal insulating layer to be spaced apart from the first coil pattern and the first lead-out pattern, and in contact with the second connection electrode.

5. The coil component of claim 4, wherein the coil portion further comprises:

a first auxiliary lead-out pattern disposed on the another surface of the internal insulating layer to be spaced apart from the second coil pattern; and a second auxiliary lead-out pattern disposed on the another surface of the internal insulating layer to be in contact with the second coil pattern and to be spaced apart from the first auxiliary lead-out pattern, wherein the support electrode is in contact with the first auxiliary lead-out pattern or the second auxiliary lead-out pattern.

6. The coil component of claim 4, wherein the support electrode includes a pair of support electrodes, wherein the coil portion further comprises:

a first auxiliary lead-out pattern disposed on the another surface of the internal insulating layer to be spaced apart from the second coil pattern; and a second auxiliary lead-out pattern disposed on the another surface of the internal insulating layer to be in contact with the second coil pattern and to be spaced apart from the first auxiliary lead-out pattern, and wherein the pair of support electrodes are respectively disposed on the first and second auxiliary lead-out patterns to be spaced apart from each other.

7. The coil component of claim 6, wherein the coil portion further comprises:

first, second, third, and fourth bonding enhancing portions, each extending from a respective one of the first and second lead-out patterns and the first and second auxiliary lead-out patterns to be exposed to an end surface of the body connecting the one surface and the another surface of the body to each other.

8. The coil component of claim 7, wherein at least one of the first, second, third, and fourth bonding enhancing portions is provided with a plurality of bonding enhancing portions disposed on the respective one of the first and second lead-out patterns and the first and second auxiliary lead-out patterns.

9. A coil component comprising:

a body having opposing first and second surfaces, and having a plurality of side surfaces extending between the first and second surfaces;

an internal insulating layer disposed in the body;

a coil including a plurality of coil turns disposed on a surface of the insulating layer facing the first surface;

a first connection electrode embedded in the body, spaced apart from the side surfaces of the body, and extending between the coil and the first surface of the body; and a support electrode embedded in the body, spaced apart from the side surfaces of the body, and extending between the coil and a portion of the second surface of the body devoid of any external electrode thereon.

10. The coil component of claim 9, further comprising a second connection electrode embedded in the body, spaced apart from the side surfaces of the body, and extending between the coil and the first surface of the body, wherein the first and second connection electrodes extend from opposite ends of the coil having the plurality of turns therebetween.

11. The coil component of claim 9, wherein the support electrode has a smaller cross-sectional area, measured in a plane parallel to the first surface, than a cross-sectional area of the first connection electrode, measured in a plane parallel to the first surface.

12. The coil component of claim 9, wherein interfaces between the coil and each of the first connection electrode and the support electrode are free of any seed layer.

13. The coil component of claim 9, wherein the coil turns of the coil are disposed on the surface of the insulating layer facing the first surface and on a second surface of the insulating layer opposite the surface of the insulating layer facing the first surface.

14. The coil component of claim 13, wherein the coil comprises:

a first lead-out portion disposed on the surface of the insulating layer facing the first surface to contact the coil turns on the surface of the insulating layer facing the first surface, and contacting the first connection electrode; and a first auxiliary lead-out portion disposed on the second surface of the insulating layer to overlap with the first lead-out portion, and contacting the first connection electrode.

15. The coil component of claim 14, wherein the coil further comprises a conductive via extending through the internal insulating layer between the first lead-out portion and the first auxiliary lead-out portion.

16. A coil component comprising:

a body having one surface and another surface opposing each other in one direction;

an internal insulating layer embedded in the body;

a coil portion, disposed on the internal insulating layer, forming at least one turn;

first and second external electrodes disposed on the one surface of the body to be spaced apart from each other;

first and second connection electrodes respectively penetrating through the body to connect the coil portion and the first and second external electrodes to each other; and a support electrode extending from the coil portion to be exposed to the another surface of the body to support the coil portion and the internal insulating layer, wherein the coil portion comprises:

first and second coil patterns, respectively disposed on one surface and another surface of the internal insulating layer opposing each other;

a first lead-out pattern disposed on the one surface of the internal insulating layer facing the one surface of the body, and in contact with the first coil pattern and the first connection electrode; and a second lead-out pattern disposed on the one surface of the internal insulating layer to be spaced apart from the first coil pattern and the first lead-out pattern, and in contact with the second connection electrode, wherein the support electrode includes a pair of support electrodes, wherein the coil portion further comprises:

a first auxiliary lead-out pattern disposed on the another surface of the internal insulating layer to be spaced apart from the second coil pattern; and a second auxiliary lead-out pattern disposed on the another surface of the internal insulating layer to be in contact with the second coil pattern and to be spaced apart from the first auxiliary lead-out pattern, wherein the pair of support electrodes are respectively disposed on the first and second auxiliary lead-out patterns to be spaced apart from each other, and wherein the coil portion further comprises:

first, second, third, and fourth bonding enhancing portions, each extending from a respective one of the first and second lead-out patterns and the first and second auxiliary lead-out patterns to be exposed to an end surface of the body connecting the one surface and the another surface of the body to each other.

17. The coil component of claim 16, wherein at least one of the first, second, third, and fourth bonding enhancing portions is provided with a plurality of bonding enhancing portions disposed on the respective one of the first and second lead-out patterns and the first and second auxiliary lead-out patterns.

* * * * *